US005909846A

United States Patent [19]

Sasaki

[11] Patent Number: 5,909,846

[45] Date of Patent: Jun. 8, 1999

[54] NOZZLE PLATE FOR FILLING LIQUID

[75] Inventor: Masanori Sasaki, Fujisawa, Japan

[73] Assignee: Tetra Laval Holdings & Finance S.A., Pully, Switzerland

[21] Appl. No.: 08/809,625

[22] PCT Filed: Sep. 26, 1995

[86] PCT No.: PCT/JP95/01935

§ 371 Date: May 15, 1997

§ 102(e) Date: May 15, 1997

[87] PCT Pub. No.: WO96/09956

PCT Pub. Date: Apr. 4, 1996

[30] Foreign Application Priority Data

Sep. 28, 1994 [JP] Japan ..... 6-259524

[51] Int. Cl.[6] ..... B05B 15/00; B05B 1/14

[52] U.S. Cl. ..... 239/106; 553/590; 222/571; 347/47

[58] Field of Search ..... 239/104, 106, 239/119, 120, 548, 553, 553.3, 553.5, 554, 555, 568, 590.3, 590.5, 596, 590, 601, 533.1, DIG. 23, DIG. 19; 222/108, 571; 347/47; 205/75

[56] References Cited

U.S. PATENT DOCUMENTS

| | | | |
|---|---|---|---|
| 4,057,190 | 11/1977 | Kiwior et al. | 239/568 X |
| 4,066,491 | 1/1978 | Ruh et al. | 239/601 X |
| 4,169,008 | 9/1979 | Kurth | 347/47 X |
| 4,528,070 | 7/1985 | Gamblin | 347/47 X |
| 4,958,669 | 9/1990 | Ohta | 222/108 X |
| 5,094,278 | 3/1992 | Arao et al. | 239/590.3 X |
| 5,167,776 | 12/1992 | Bhaskar et al. | 205/75 |
| 5,472,144 | 12/1995 | McDonald | 239/590.3 X |
| 5,484,507 | 1/1996 | Ames | 347/47 X |

FOREIGN PATENT DOCUMENTS

| | | |
|---|---|---|
| 62-135104 | 6/1987 | Japan . |
| 497010 | 8/1992 | Japan . |

OTHER PUBLICATIONS

U.S. application No. 07/566903, Denis et al., filed Aug. 1990.

*Primary Examiner*—Andres Kashnikow
*Assistant Examiner*—Steven J. Ganey
*Attorney, Agent, or Firm*—Loeb & Loeb LLP

[57] ABSTRACT

A liquid filling nozzle plate is formed from a plate member provided with a plurality of through-holes. The liquid filling nozzle plate is attached to the lower end opening of a liquid filling tube of a liquid filling device. Liquid filling the liquid filling tube is prevented from flowing out of the tube and plate by surface tension in the through-holes of the liquid filling nozzle plate. The inner peripheral surface of each through-hole is provided with a circumferential projection projecting in a direction in which the inner diameter of the through-hole is reduced. The resulting cross-sectional configuration of the through-holes increases the surface tension of the through-holes to effectively prevent dripping of liquid from the through-holes. Dripping of liquid from the through-holes can also be prevented by providing through-holes having an elongated slit-shaped opening configuration.

17 Claims, 7 Drawing Sheets

NOZZLE PLATE FOR FILLING LIQUID

BACKGROUND OF THE INVENTION

1. Field of the Invention

The present invention relates to a liquid filling nozzle plate used to fill a container with a liquid.

2. Discussion of the Related Art

Conventionally, liquid filling apparatuses have been developed and used for automatically filling containers with liquids, e.g. milk and juice.

FIG. 10 is a sectional side view schematically showing an essential part of a liquid filling apparatus of the type described above. As shown in the figure, the liquid filling apparatus is arranged as follows: A pipe 61 is connected to the bottom of a liquid tank 60, and two check valves 63 and 65 are installed in the pipe 61. Further, a liquid filling tube 67 is attached to a portion of the pipe 61 below the check valves 63 and 65, while a pipe 69 is connected to a portion of the pipe 61 between the two check valves 63 and 65, and a liquid volumetric discharge machine 71 is attached to the lower end of the pipe 69.

Both the two check valves 63 and 65 are resiliently biased upwardly by respective coil springs 64 and 66 so that a liquid can be led only downwardly.

The liquid volumetric discharge machine 71 has a cylinder 73 and a piston 75 vertically movably received in the cylinder 73. The vertical stroke of the piston 75 is fixed.

A liquid filling nozzle plate 80 is attached to the lower end opening of the liquid filling tube 67.

FIGS. 11(*a*) and 11(*b*) show the conventional liquid filling nozzle plate 80. FIG. 11(*a*) is a plan view, and FIG. 11(*b*) is a front view. As shown in the figures, the liquid filling nozzle plate 80 is formed from a metallic disk 81 provided with a large number of through-holes 83.

There is another conventional nozzle plate consisting of a sieve plate formed from a wire net. This nozzle plate is constructed of a wire net formed by weaving a plurality of longitudinal and lateral metal wires. In this nozzle plate, through-holes are formed in the gaps between the wires.

Next, the operation of the liquid filling apparatus will be described by using mainly FIG. 10. First, the liquid in the liquid tank 60 fills a part extending from the top of the pipe 61 to the end of the liquid filling tube 67 and a part extending from the top of the pipe 69 to the top of the piston 75.

When the piston 75 is pushed down in the direction of the arrow A, the check valve 63 opens, and the liquid in the liquid tank 60 is introduced into the liquid volumetric discharge machine 71.

Then, when the piston 75 is pushed up in the direction of the arrow B, the check valve 63 is closed, while the check valve 65 opens. Consequently, the liquid in the liquid volumetric discharge machine 71 is passed through the liquid filling tube 67 and discharged from the through-holes 83 of the liquid filling nozzle plate 80, thereby being supplied into a container (not shown).

The liquid filling nozzle plate 80 is provided to prevent the liquid filling the liquid filling tube 67 from flowing out (so-called dripping) when no liquid is desired to discharge from the liquid filling nozzle plate 80.

More specifically, the surface tension of the liquid filling the liquid filling tube 67 acts in the large number of through-holes 83 provided in the liquid filling nozzle plate 80, thereby preventing the liquid from flowing out by gravity. Thus, dripping of liquid is prevented.

However, the through-holes 83 provided in the conventional liquid filling nozzle plate 80 are so shaped that, as shown in the sectional view of FIG. 12, the inner surfaces 85 of the through-holes 83 extend straight in the vertical direction.

Therefore, the surface tension acting in the through-holes 83 is not satisfactorily high, so that dripping of liquid is likely to occur. To increase the surface tension in order to prevent dripping of liquid, the diameters of the through-holes 83 may be reduced. However, if the diameters of the through-holes 83 are reduced, the fluid resistance occurring when the liquid is discharged increases undesirably.

In contrast, the wire-net sieve plate provides relatively large surface tension owing to the complicated surface configuration of the openings and is therefore capable of effectively preventing dripping of liquid. With the wire-net sieve plate, however, solid matters in the filling liquid, e.g. fibers and fruit flesh, may be entangled or caught in the intersections of the wires, causing the sieve plate to be clogged. Moreover, because the sieve plate is a wire net, the mechanical strength is low.

In view of the above-described circumstances, an object of the present invention is to provide a liquid filling nozzle plate capable of effectively preventing dripping of liquid without the need to reduce the diameters of through-holes.

Another object of the present invention is to provide a liquid filling nozzle plate capable of effectively preventing dripping of liquid without causing the holes to be clogged with solid matter in the filling liquid.

Still another object of the present invention is to provide a liquid filling nozzle plate having high mechanical strength.

SUMMARY OF THE PREFERRED EMBODIMENTS

To attain the above-described objects, the present invention provides a liquid filling nozzle plate comprising a plate member provided with a large number of through-holes, the nozzle plate being attached to the lower end opening of a liquid filling tube to prevent a liquid filling the liquid filling tube from flowing out by the surface tension of the liquid, wherein the inner peripheral surface of each of the through-holes provided in the liquid filling nozzle plate is provided with a circumferential projection projecting in a direction in which the inner diameter of the through-hole is reduced.

In addition, the present invention provides a liquid filling nozzle plate comprising a plate member provided with a large number of through-holes, the nozzle plate being attached to the lower end opening of a liquid filling tube so as to prevent a liquid filling the liquid filling tube from flowing out by the surface tension of the liquid, wherein the through-holes provided in the liquid filling nozzle plate each have an elongated slit-shaped opening configuration.

According to either of the above-described inventions, the surface tension acting to hold the liquid in the through-holes increases, whereby dripping of liquid from the through-holes can be effectively prevented.

DETAILED DESCRIPTION OF THE PREFERRED EMBODIMENTS

Embodiments of the present invention will be described below in detail with reference to the drawings.

Figure 1:
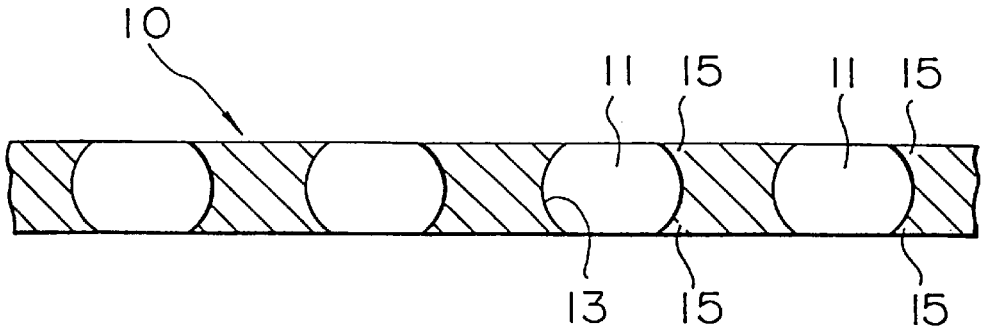
FIG. 1 an enlarged sectional side view of an essential part of a liquid filling nozzle plate 10 according to one embodiment of the present invention.

FIG. 1 is an enlarged sectional side view of an essential part of a liquid filling nozzle plate 10 according to one embodiment of the present invention. As shown in the figure, through-holes 11 in the liquid filling nozzle plate 10 are each provided with circumferential projections 15 at the upper and lower ends of the inner peripheral surface 13 thereof such that the projections 15 project in a direction in which the inner diameters of the through-holes 11 are reduced.

It should be noted that these projections 15 describe approximately circular arcs as seen in a sectional side view, and thus the inner surface of each through-hole 11 defines a configuration approximately similar to a sphere with its upper and lower ends cut parallel to each other.

Figure 2A:
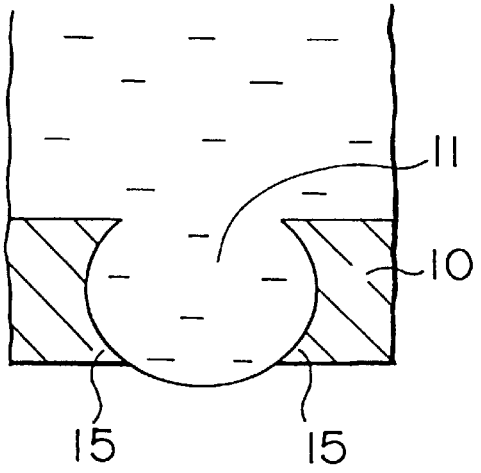
FIGS. 2(*a*) and 2(*b*) are views for comparatively describing the operation of the liquid filling nozzle plate 10 according to the present invention of this application and the operation of a liquid filling nozzle plate 80 according to the prior art.
Figure 2B:
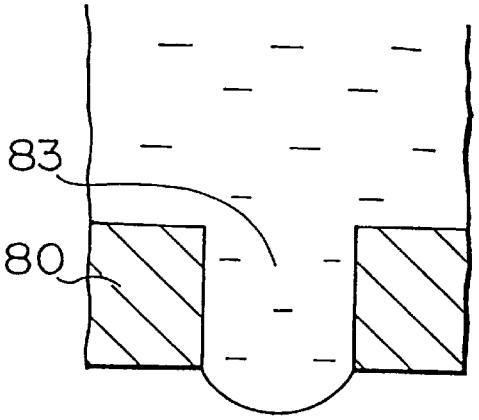
FIG. 2(b) PRIOR ART

It has been confirmed by an experiment carried out by the inventor of this application that dripping of liquid can be prevented more reliably than in the prior art by forming the through-holes 11 as described above. The reason for this may be considered as follows:

In this embodiment, as shown in FIG. 2(*a*), a liquid filling the space above the liquid filling nozzle plate 10 also fills each through-hole 11. However, the liquid is kept from dropping from the through-hole 11 by the surface tension in a state where the liquid surface projects downward in an approximately circular arc shape from the underside of the through-hole 11.

In the case of the liquid filling nozzle plate 80 according to the prior art, as shown in FIG. 2(*b*), the liquid filling each through-hole 83 is kept from dropping by the surface tension in a state where the liquid surface projects downward in an approximately circular arc shape from the underside of the through-hole 83.

In comparison of the two nozzle plates, the through-hole 11 in this embodiment is provided at its lower end with a projection 15, which projects inwardly. The projection 15 extends in a direction which is approximately coincident with the circular arc defined by the liquid surface projecting in an approximately circular arc shape from the underside of the through-hole 11. In other words, the direction in which the projection 15 of the through-hole 11 projects approximately coincides with the direction of the surface tension in which the liquid surface tends to form a circular arc shape. Consequently, the liquid can be effectively held at the lower end of the through-hole 11.

In the prior art, on the other hand, the whole inner peripheral surface of the through-hole 83 extends straight in the vertical direction. Therefore, the circular arc defined by the liquid surface projecting in an approximately circular arc shape at the lower end of the through-hole 83 is not at all coincident with the shape of the lower end portion of the through-hole 83. Accordingly, force that holds the liquid at the lower end of the through-hole 83 is smaller than in the case of the above-described embodiment of this application.

Incidentally, the liquid filling nozzle plate 10 according to this embodiment is produced by etching or machining a corrosion-resistant metal sheet.

Figure 3:
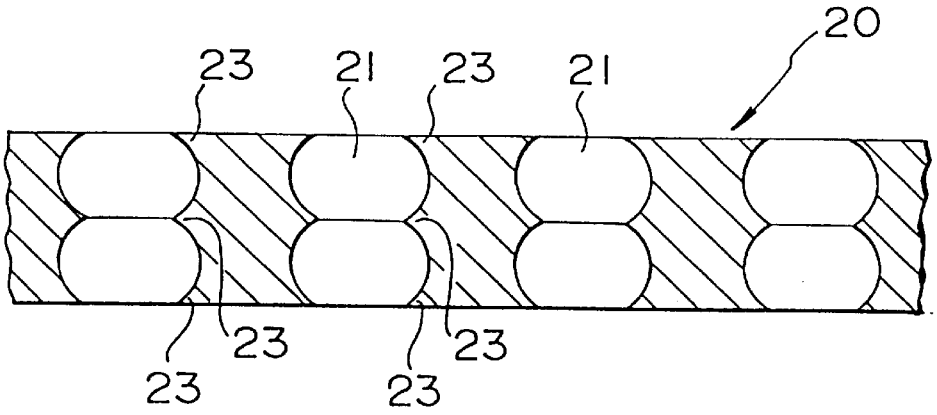
FIG. 3 is an enlarged sectional side view of an essential part of a liquid filling nozzle plate 20 according to another embodiment.

Next, FIG. 3 is an enlarged sectional side view of an essential part of a liquid filling nozzle plate 20 according to another embodiment. As shown in the figure, in this embodiment an inwardly projecting circumferential projection 23 is also provided at the center of each through-hole 21 in addition to those provided at the upper and lower ends of the through-hole 21. With this arrangement, force that acts to hold the liquid also acts at the central projection 23, and at the same time, the length of the through-hole 21 increases. Therefore, the surface tension acts even more effectively to hold the liquid.

Figure 4:
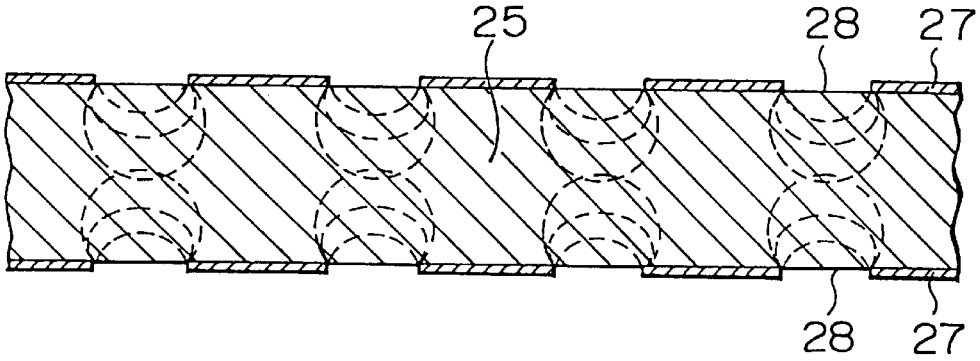
FIG. 4 shows one example of a method of producing the liquid filling nozzle plate 20.

FIG. 4 is a view showing one example of a method of producing the liquid filling nozzle plate 20. As shown in the figure, the liquid filling nozzle plate 20 is produced by coating a mask material 27 on both sides of a corrosion-resistant metal plate 25. At this time, those portions of the metal plate 25 which are to become upper and lower openings of the through-holes 21 are left as circular portions 28 not coated with the mask material. When the metal plate 25 is dipped in an etching solution, the metal plate 25 is etched from the surfaces of the portions 28 as shown by the dotted lines. Thus, a liquid filling nozzle plate 20 such as that shown in FIG. 3 can be produced.

However, the etching rate changes with the concentration of the etching solution, etc. Consequently, the resulting through-holes 21 do not always have a configuration such as that shown in FIG. 3. It is therefore necessary to select an etching material and other conditions.

Figure 5:
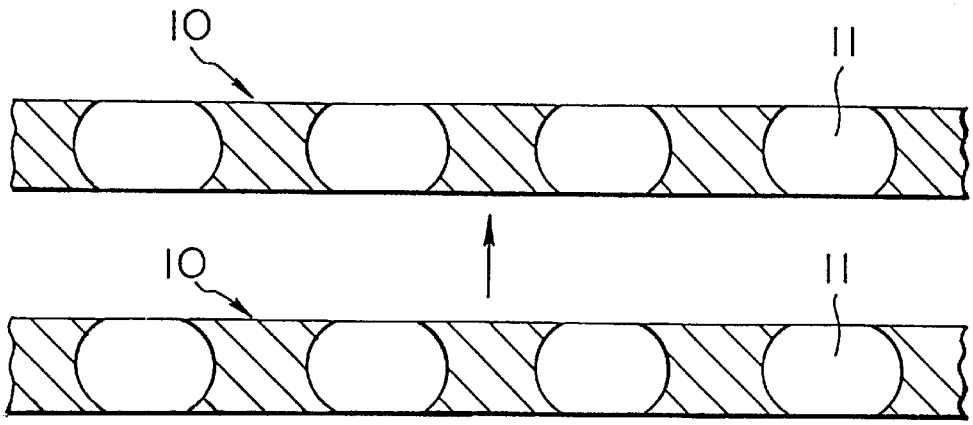
FIG. 5 shows another method of producing the liquid filling nozzle plate 20.

It should be noted that the liquid filling nozzle plate 20 may also be produced as shown in FIG. 5. That is, two liquid filling nozzle plates 10 as shown in FIG. 1 are prepared, and the two nozzle plates 10 are laid one on top of the other and fixed together as one unit.

Figure 6:
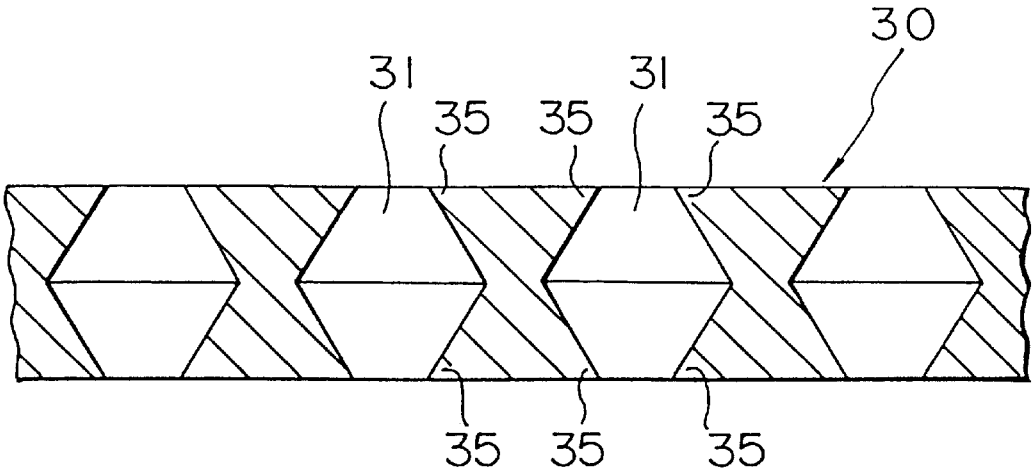
FIG. 6 is an enlarged sectional side view of an essential part of a liquid filling nozzle plate 30 according to still another embodiment.

Next, FIG. 6 is an enlarged sectional side view showing an essential part of a liquid filling nozzle plate 30 according to still another embodiment. In this embodiment also, projections 35 are provided at the upper and lower ends of each through-hole 31 as in the case of the above-described embodiment shown in FIG. 1. However, this embodiment differs from the embodiment shown in FIG. 1 in that each through-hole 31 has an inner surface configuration defined by two frustums of right-circular cones joined together at their bases.

With the through-holes 31 formed as described above also, dripping of liquid can be prevented more reliably than in the prior art for the same reason stated above in connection with the embodiment shown in FIG. 1.

Figure 7:
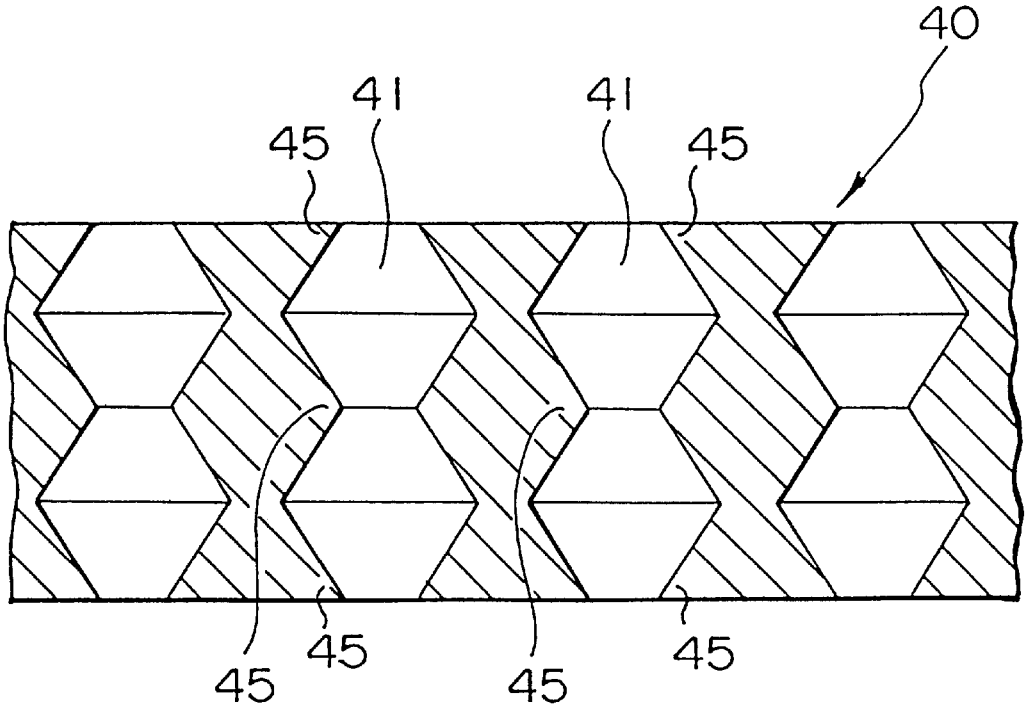
FIG. 7 is an enlarged sectional side view showing a liquid filling nozzle plate 40 according to a further embodiment.
Figure 8A:
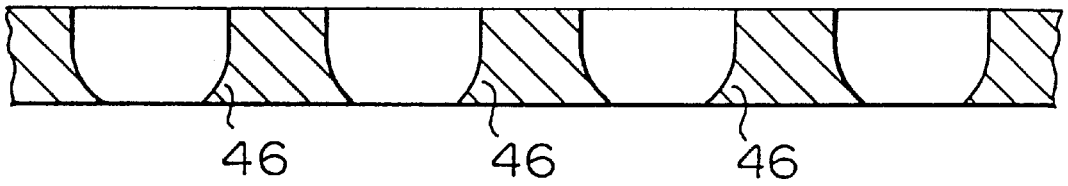
FIGS. 8(*a*), 8(*b*), 8(*c*) and 8(*d*) are enlarged sectional side views respectively showing the structures of through-holes in liquid filling nozzle plates according to still further embodiments.
Figure 8B:
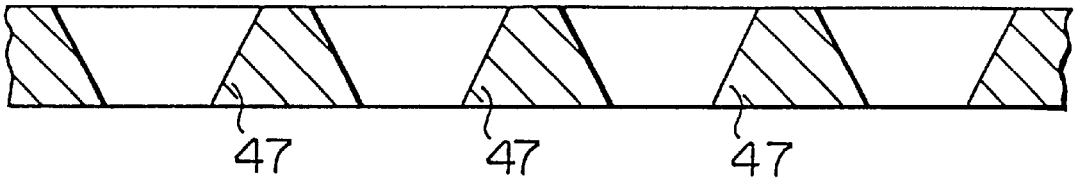
Figure 8C:
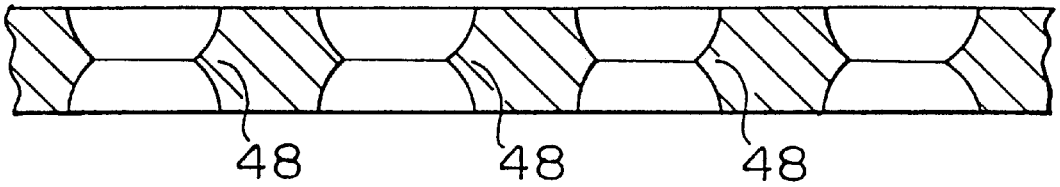
Figure 8D:
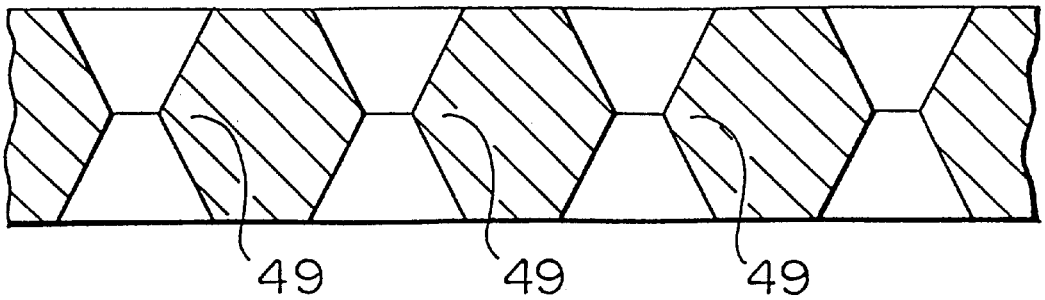

Next, FIG. 7 is an enlarged sectional side view showing a liquid filling nozzle plate 40 according to a further embodiment. This embodiment is produced by laying two liquid filling nozzle plates 30 as shown in FIG. 6 one on top of the other and fixing them together as one unit. With this arrangement, force that acts to hold the liquid also acts at the central projection 45 in each through-hole 41, and at the same time, the length of the through-hole 41 increases. Therefore, dripping of liquid can be prevented even more effectively.

Next, FIGS. 8(*a*), 8(*b*), 8(*c*) and 8(*d*) are enlarged sectional side views respectively showing the structures of through-holes in liquid filling nozzle plates according to still further embodiments.

More specifically, as shown in FIGS. 8(*a*) and 8(*b*), each through-hole in a liquid filling nozzle plate may be provided with a projection 46 or 47 only at the lower end thereof. Alternatively, as shown in FIGS. 8(*c*) and 8(*d*), each through-hole may be provided with a projection 48 or 49 only at the center thereof.

Although in the above-described embodiments the through-holes have a circular configuration (as seen from above the liquid filling nozzle plate), it should be noted that the present invention is not necessarily limited to the circular configuration, and that the through-holes may have other configurations, e.g. a square, rectangular, elliptical or polygonal configuration, as a matter of course.

Figure 9:
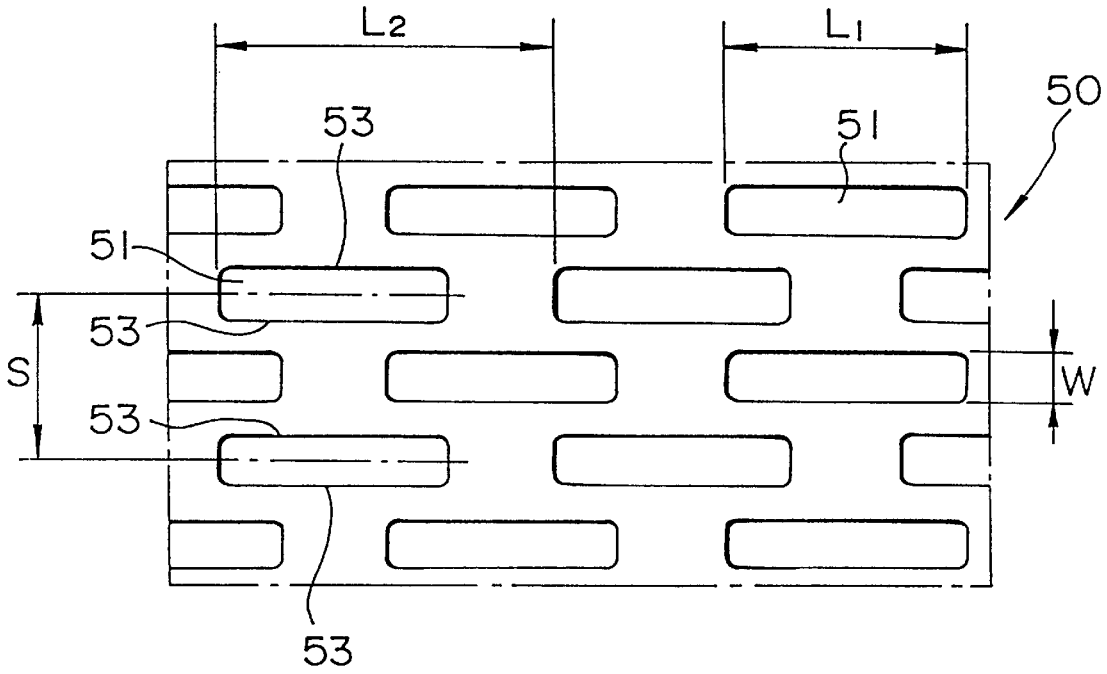
FIG. 9 is an enlarged plan view of an essential part of a liquid filling nozzle plate 50 according to one embodiment of the present invention.
Figure 10:
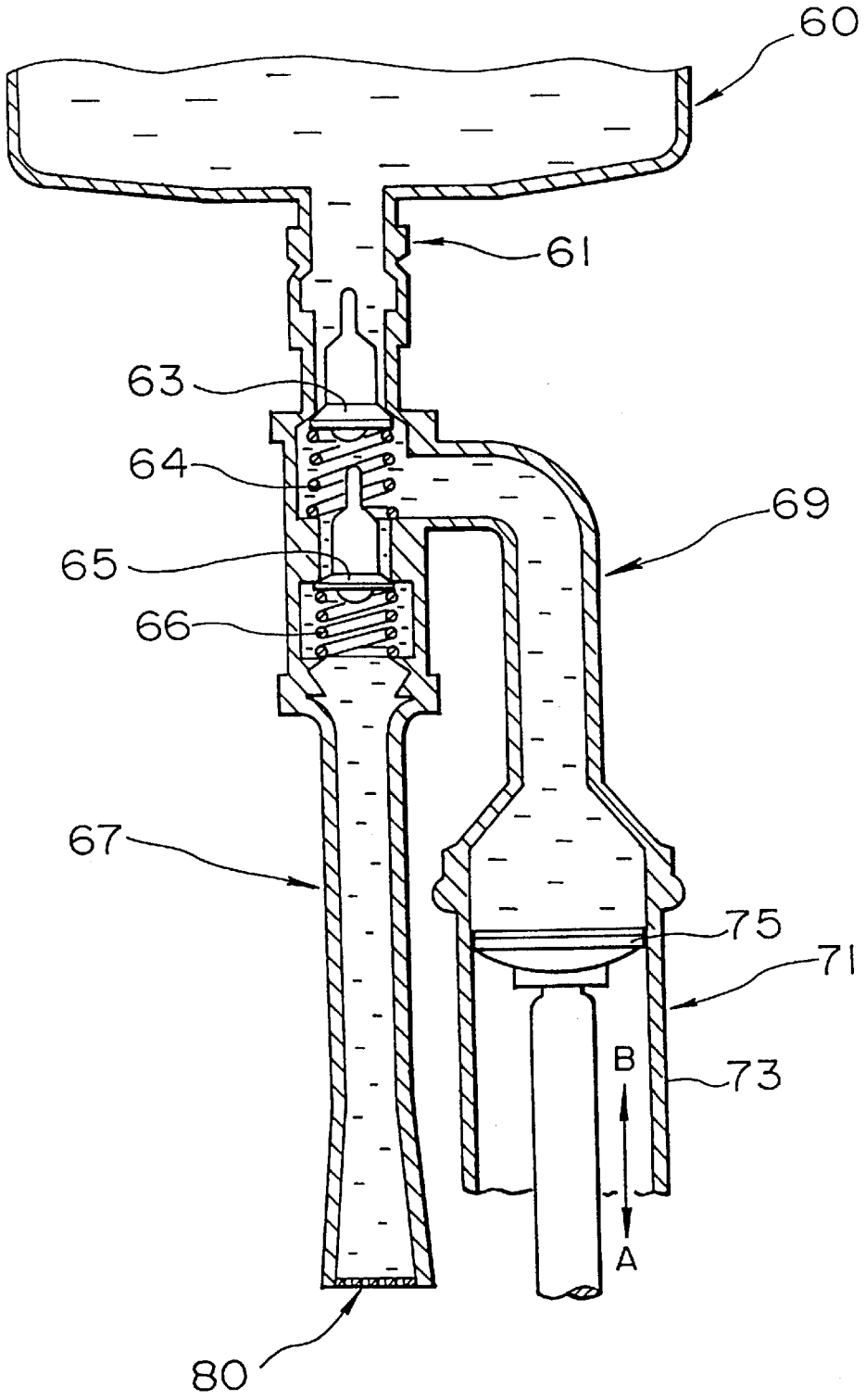
FIG. 10 PRIOR ART
FIG. 10 is a sectional side view schematically showing an essential part of a conventional liquid filling apparatus.
Figure 11A:
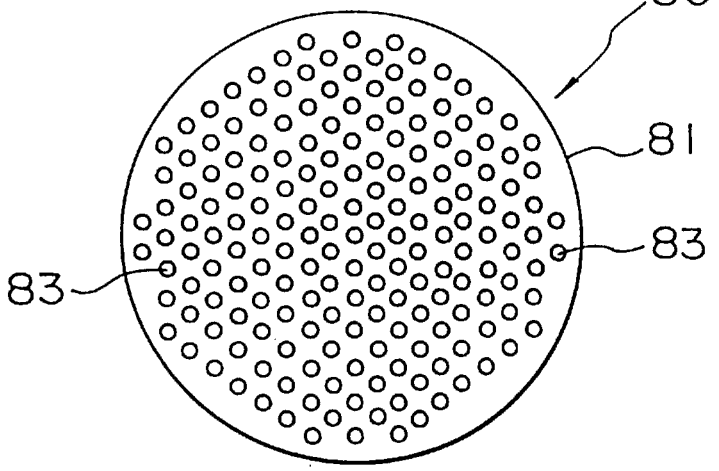
FIG. 11(a) PRIOR ART
FIGS. 11(*a*) and 11(*b*) are plan and front views, respectively, showing a conventional liquid filling nozzle plate 80.
Figure 11B:
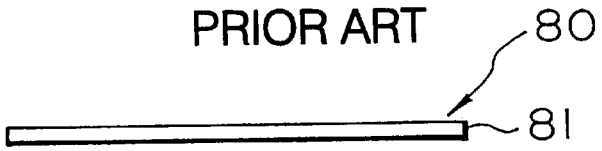
FIG. 11(b) PRIOR ART
Figure 12:
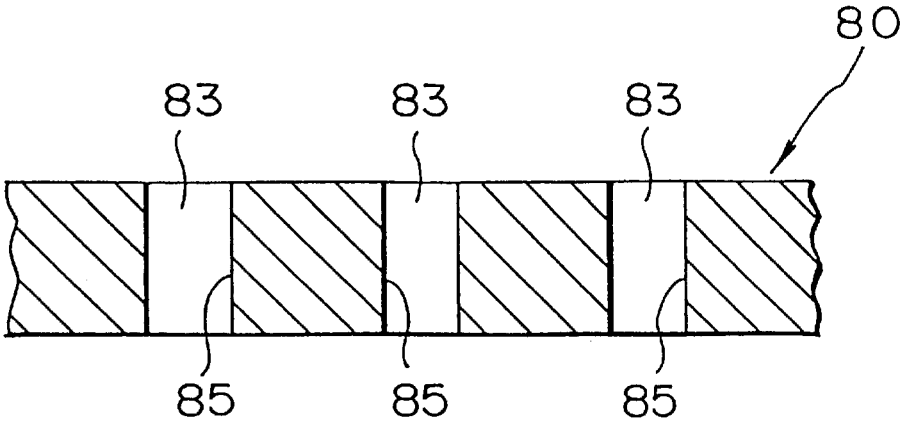
FIG. 12 PRIOR ART
FIG. 12 is an enlarged sectional side view of an essential part of the conventional liquid filling nozzle plate 80.

FIG. 9 is an enlarged plan view of an essential part of a liquid filling nozzle plate 50 according to one embodiment of the present invention. As shown in the figure, through-holes 51 provided in the liquid filling nozzle plate 50 have an elongated slit-like shape.

It has been confirmed by an experiment carried out by the inventor of this application that dripping of liquid can be prevented more reliably than in the prior art by forming the through-holes 51 as described above. The reason for this may be considered as follows:

In the through-holes 51 according to this embodiment, two longitudinal opposite sides 53 are close to each other; therefore, the surface tension increases correspondingly, and thus dripping of liquid is prevented more effectively than in the case of through-holes of the same area which have other shapes (circular or square shape). As the two sides 53 are brought closer to each other, the surface tension increases, as will be understood from the phenomenon that, when the lower ends of two parallel flat plates disposed close to each other are immersed in a water tank, for example, the height of a water column pulled up in the space defined between the two flat plates by the capillary action increases as the spacing between the two flat plates decreases.

It should be noted that the opening ratio F of the liquid filling nozzle plate 50 according to this embodiment is preferably in the range of from 65% to 35%, more preferably in the range of from 67% to 43%. The expression of the opening ratio P is shown below:

$$F=\{(2WL_1-0.43W)/SL_2\}\times 100(\%)$$

where W: the width (at the shorter side) of the through-holes 51

$L_1$: the width (at the longer side) of the through-holes 51

$L_2$: the pitch between the through-holes 51 in a direction parallel to the longer side S: the pitch between the through-holes 51 in a direction parallel to the shorter side Industrial Applicability:

As has been described above, the liquid filling nozzle plate according to the present invention is used being attached to the lower end opening of a liquid filling tube of a liquid filling apparatus. The liquid filling nozzle plate effectively prevents dripping of liquid from the liquid filling tube.

What is claimed is:

1. A liquid filling nozzle plate for a liquid filling device comprising a plate member provided with a plurality of through-holes, said nozzle plate being attached to a lower end opening of a liquid filling tube of the liquid filling device to prevent liquid filling said liquid filling tube from flowing out of said plate as a result of surface tension of said liquid, wherein an inner peripheral surface of each of said through-holes provided in said liquid filling nozzle plate is provided with a circumferential projection projecting in a direction in which an inner diameter of the through-hole is reduced to increase surface tension in the through-hole.

2. A liquid filling nozzle plate according to claim 1, wherein said through-holes each have an approximately circular or opening configuration.

3. A liquid filling nozzle plate according to claim 1, wherein said projection is provided at a lower end of each through-hole.

4. A liquid filling nozzle plate according to claim 1, wherein said through-holes each have an elongated slit-shaped opening configuration.

5. A liquid filling nozzle plate according to claim 1, comprising a plurality of said liquid filling nozzle plates each having said projection provided in each through-hole, said liquid filling nozzle plates being laid one on top of another.

6. A liquid filling nozzle plate according to claim 1, wherein said through-holes each have an approximately elliptical opening configuration.

7. A liquid filling nozzle plate according to claim 1, wherein said projection is provided at each of upper and lower ends in each through-hole.

8. A liquid filling nozzle plate according to claim 1, wherein said projection is provided at a central portion in each through-hole.

9. A liquid filling nozzle plate according to claim 1, wherein said projection is provided at each of an upper end, a lower end and a central portion in each through-hole.

10. A liquid filling nozzle plate according to claim 1, wherein said projection extends in a direction approximately coincident with a circular arc defined by a liquid surface of said liquid projecting in an approximately circular arc shape from a lower end of the through-hole.

11. A liquid filling nozzle plate for a liquid filling device comprising a plate member provided with a plurality of through-holes, said nozzle plate being attached to a lower end opening of a liquid filling tube of the liquid filling device to prevent liquid filling said liquid filling tube from flowing out of said plate as a result of surface tension of said liquid, wherein said through-holes provided in said liquid filling nozzle plate each have an elongated slot-like shape to increase surface tension in the through-hole, and wherein an inner peripheral surface of each of said through-holes is provided with a circumferential projection projecting in a direction in which an inner diameter of the through-hole is reduced.

12. A liquid filling nozzle plate according to claim 11, wherein said projection is provided at a lower end of each through-hole.

13. A liquid filling nozzle plate according to claim 7, wherein an opening ratio of said through-holes is in a range of from 67% to 43%.

14. A liquid filling nozzle plate according to claim 11, wherein said projection is provided at each of upper and lower ends in each through-hole.

15. A liquid filling nozzle plate according to claim 11, wherein said projection is provided at a central portion in each through-hole.

16. A liquid filling nozzle plate according to claim 11, wherein said projection is provided at each of an upper end, a lower end and a central portion in each through-hole.

17. A liquid filling nozzle plate according to claim 11, wherein an opening ratio of said through-holes is in a range of from 67% to 35%.

* * * * *